United States Patent [19]

Weir

[11] 4,411,083

[45] Oct. 25, 1983

[54] LAUNDRY SPREADER

[75] Inventor: Henry J. Weir, Chepstow, Wales

[73] Assignee: H. J. Weir Engineering Co., Ltd., England

[21] Appl. No.: 312,533

[22] Filed: Oct. 19, 1981

Related U.S. Application Data

[63] Continuation-in-part of Ser. No. 209,018, Nov. 12, 1980, abandoned.

[30] Foreign Application Priority Data

Nov. 22, 1979 [IE] Ireland ..... 2227/79

[51] Int. Cl.[3] ..... D06F 59/08

[52] U.S. Cl. ..... 38/143

[58] Field of Search ..... 38/143, 7

[56] References Cited

U.S. PATENT DOCUMENTS 3,376,036 4/1968 Weir ..... 38/143

4,106,227 8/1978 Allen et al. ..... 38/143

FOREIGN PATENT DOCUMENTS 2258698 7/1974 Fed. Rep. of Germany ..... 38/143

*Primary Examiner*—Werner H. Schroeder

*Assistant Examiner*—Andrew M. Falik

*Attorney, Agent, or Firm*—Wallenstein, Wagner, Hattis, Strampel & Aubel

[57] ABSTRACT

A simplified apparatus for centering and spreading laundry articles on the conveyor of a machine automatically feeding such articles to a commercial laundry iron and comprising lead and trailing carriages having clipping apparatus for gripping adjacent corners of such articles, a track to convey the carriages, a belt driven by a motor for moving the carriages on the track. The lead carriage is directly affixed to the first run of the belt, the trailing carriage idles with respect to the second run of the belt. Upon activation of the motor, the lead carriage moves down the track drawing the laundry article along the front of the inlet end of the conveyor. An abutment affixed on the second run of the belt contacts the trailing carriage creating tension in the leading edge of the laundry article. Movement of the abutment with respect to the second run of the belt is made adjustable so that the position of the line about which the articles are centered may be varied.

5 Claims, 10 Drawing Figures

36
38
40
60
20
42
96
98
94
100
68
92
74
78
62
30
90
86
88
26
28
28
9
9
64
64
56
56

LAUNDRY SPREADER

REFERENCE TO RELATED APPLICATION

This application is a continuation-in-part of U.S. Ser. No. 209,018, filed Nov. 12, 1980 abandoned.

TECHNICAL FIELD

The present invention relates generally to devices which center and spread laundry articles on a conveyor automatically feeding a commercial laundry ironer and, more specifically, in its most preferred form, to an improved centering and spreading apparatus for laundry articles which is capable of dividing the feeding conveyor into a two-lane system.

SUMMARY AND BACKGROUND OF INVENTION

The present invention relates to a simplified apparatus for centering and spreading laundry articles on the conveyor of a machine automatically feeding such articles to a commercial laundry ironer. Typically, the articles of concern in the commercial ironing process are flat-work articles, such as bed-sheet, table-cloths, pillow-cases, and the like. The automatic feeding machines employed in the ironing process generally are comprised of a conveyor, on which the laundry articles are laid for feeding to a commercial ironer, and several clipping means, which are conveyed in carriages, for gripping adjacent corners or edges of the particular article. When the carriages, each with respective clipping means, are drawn apart, centering and stretching of the leading edge of the article across the front of the inlet end surface of the conveyor is achieved. Subsequently, the article is released from the clipping means and transferred over the inlet end surface of the automatic feeding conveyor by a transfer mechanism.

Upon emerging from the commercial ironer, the articles then are fed to a folding apparatus, which causes several folds to be made in the articles. Generally, an initial primary fold is made by the folding apparatus, the fold being made about a primary fold line which bisects the width of the article and extends the entire length of the article. Subsequent to making a primary fold, the folding apparatus makes several cross folds in the article. For the folding process to result in uniform folds, and to avoid crossfolding errors, it is necessary that the article be accurately centered on the inlet end of the automatic feeding conveyor.

Several devices are known in the art which center and spread laundry on the automatic feeding conveyor. These devices achieve accurate centering of laundry articles by employing clipping means contained in movable carriages as described above. The carriages in these prior art devices start from a position located at either the side or center of the conveyor. The carriages synchronously move in outward directions from the conveyor center until the entire leading edge of the laundry article has been fully extended and centered over the conveyor surface.

However, a major disadvantage of these prior art devices is the large number of parts and elements employed in achieving the fast and accurate centering and spreading of laundry articles. Because of this complexity, problems are incurred in both the maintenance and replacement for such devices. As a result, the prior art devices are necessarily costly both to operate and maintain and are not as reliable as a more simplified apparatus. Thus, it is an object of the present invention to provide a simplified and reliable apparatus for centering and spreading laundry articles employing a minimum number of parts, yet capable of operating at the speeds of modern commercial laundry plants.

A further object of the present invention is to provide a simplified apparatus for centering and spreading laundry articles, so that the primary fold line about which the carriage centralize may be easily adjusted, resulting in the division of the inlet end of the automatic feeding conveyor into a two-lane system. This permits the simultaneous feeding of smaller flat-work articles into the commercial laundry ironer.

In accordance with the present invention, a simplified apparatus for centering and spreading laundry flat-work articles upon the inlet end of the automatic feeding conveyor is created through the combination of elements including at least two carriages, one called the leading carriage and the other called the trailing carriage. Each carriage has clipping means for gripping adjacent corners or adjacent parts of a leading edge of the laundry article. Track means confines movement of the carriages along one axis. In the preferred form thereof, at least a second pair of carriages also is provided on the same track, with each pair of carriages being initially positioned at opposite ends of the track. Separate belts, chains or similar endless means (generally referred to in the Claims as an endless elongated means) substantially extending the length of the track are associated with each pair of carriages and are suspended between respective drive and idler pulleys. Such belts have both a first and a second run. The lead carriages containing clipping means are directly affixed to the first run of each respective belt or chain, and the trailing carriages, also with clipping means, idle with respect to the second run of each respective belt or chain. Separate abutment means are directly affixed to each second run at a point thereon, where, when a carriage pair is on one end of the track, the respective abutment means is positioned on the opposite side of a desired reference center-point by the same distance as the lead carriage is spaced therefrom. Independent drive means are provided for moving each belt or chain in reversable direction which in the preferred form of the invention, is a pneumatic cylinder rack and pinion gear arrangement.

The spreading and accurate centering of laundry articles by the apparatus of the present invention can be achieved with one of two possible modes. In one mode, the carriage pairs mounted at opposite ends of a common track, share the inlet end of the conveyor. In this particular mode, the carriage pairs must alternately spread and center an article at different times about the inlet end of the conveyor. In the other possible mode, a flat-work article, held by a particular pair of carriages, can be centered along one segment of the inlet end of the conveyor while another flat-work article can simultaneously be centered by another carriage pair on a different portion of the inlet end. Thus, in this mode, the inlet end of the conveyor is utilized as a two-lane system. The manner in which the apparatus of the present invention can be adjusted to permit such dual lane usage will be more fully explained later.

In either mode, the present invention functions by affixing the adjacent corners or edges of the flat-work piece to the clipping means of each carriage while the carriages are located to one side of the track and the inlet end of the feeding conveyor. Next, the drive means is activated to move the belt or chain in a direction so that the lead carriage proceeds to move down the track to draw the flat-work piece adjacent to the conveyor. The trailing carriage, idling with respect to the second run of the belt or chain, initially moves only slightly, but soon moves down the track to a greater extent as a result of the pull by the lead carriage on the laundry article after it has become completely unfurled. The movement of the carriages in the track proceeds until the abutment means contacts the trailing carriage, at which point a switch signals the release machanism (which in the preferred form is a switch sensitive to pneumatic pressure) to release the article from the clipping means. The article is then immediately transferred onto the inlet end of the conveyor by a transfer means which may be by a jet of air, or preferably by unique mechanical blades. After transfer of the article has been accomplished, the carriage pair returns to a start position at one end of the track.

The present invention, as disclosed above, automatically spreads laundry articles about the same reference point on the conveyor irrespective of the width of such article since article width is automatically accommodated by the abutment means contacting the trailing carriage. That is, article width is automatically accommodated for since contact of the abutment means with the trailing carriage will always occur at such point in time when the lead and trailing carriages are equidistantly positioned from a given reference center-point about which the article is to be centered.

Moreover, the simple adjustment of the position of the abutment means with respect to the second run of the belt can result in the shifting of the reference center-point on the conveyor about which the carriages centralize. Such adjustment of the reference point can result in the division of the automatic feeding conveyor into a two-lane system, previously described, for feeding smaller laundry articles from loading stations located at either side of the inlet end of the conveyor.

DESCRIPTION OF EXEMPLARY EMBODIMENT OF THE INVENTION

Figure 1:
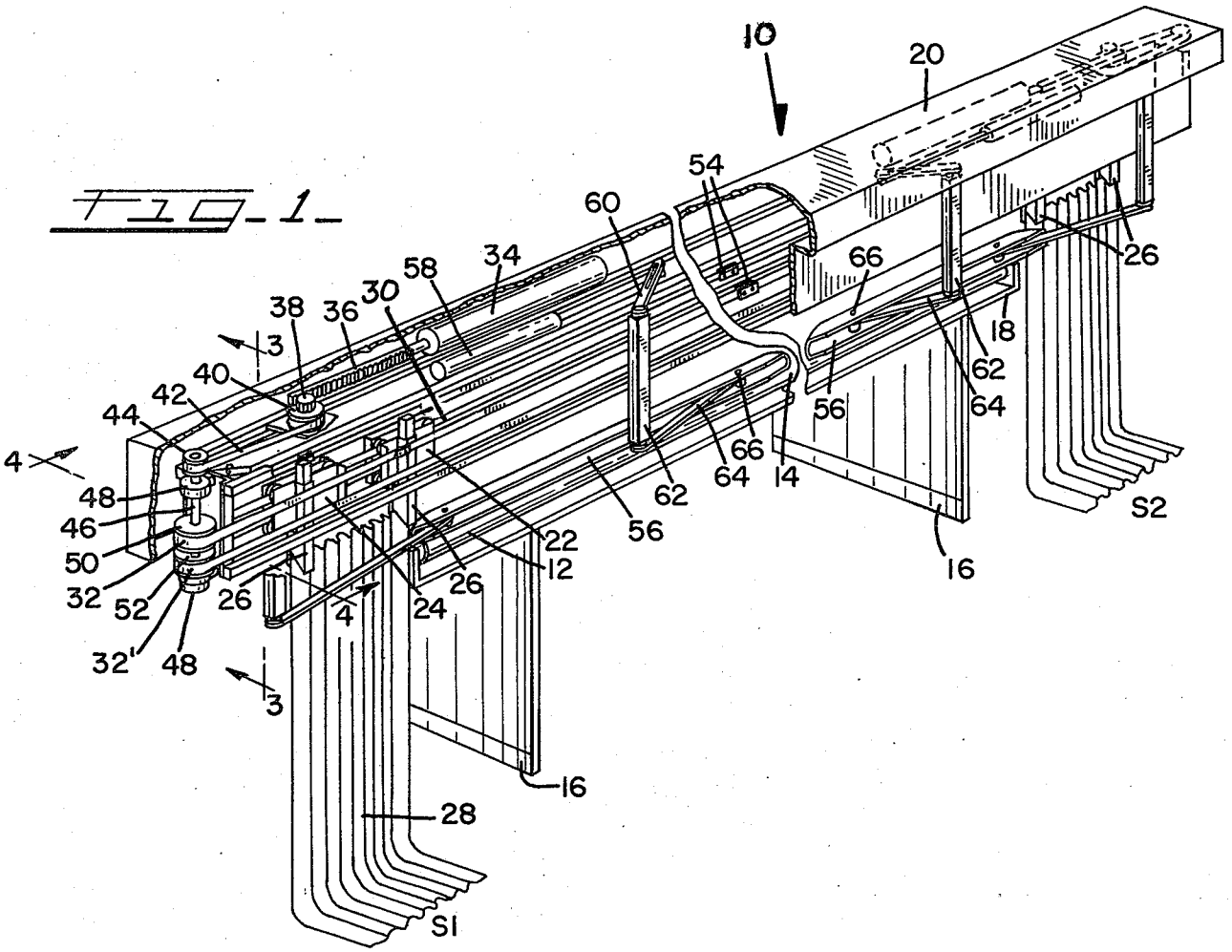
FIG. 1 is a perspective view of the preferred form of the invention utilizing two carriage pairs showing a cut-away of the apparatus housing to reveal the arrangement of elements.

Referring to the drawings, FIG. 1 discloses a centering and spreading apparatus for laundry articles, generally indicated by reference 10. FIG. 1 illustrates the arrangement of the centering and spreading apparatus 10 with respect to the automatic feeding conveyor 12 and inlet end 14 of automatic feeding conveyor 12. There are provided preferably, at least two article loading stations S1 and S2 located at each end of the apparatus beyond the sides of the conveyor 12 and positioned proximately to a start position for each respective carriage pair. Of course, a pair of confronting loading stations could be provided at each end of the apparatus to maximize apparatus output. Both the centering and spreading apparatus 10 and the automatic feeding conveyor 12 are generally supported by main support members 16 with the centering and spreading apparatus 10 elevated and supported over inlet end 14 of conveyor 12 by a support framework 18 which are directly secured to the housing 20. Each loading station is associated with a lead carriage 22 and a trailing carriage 24 each have clipping means 26 to grip respective edges of laundry article 28. Both lead carriage 22 and trailing carriage 24 at each loading station glide freely on a track 30 formed by an I-beam having tubular horizontal portions which will be more fully described hereafter.

Movement of each pair of carriages along track 30 is achieved by a carriage belt 32 or 32' to which a lead carriage 22 is directly affixed and a trailing carriage 24 idles with respect to carriage belt 32 or 32'.

Figure 3:
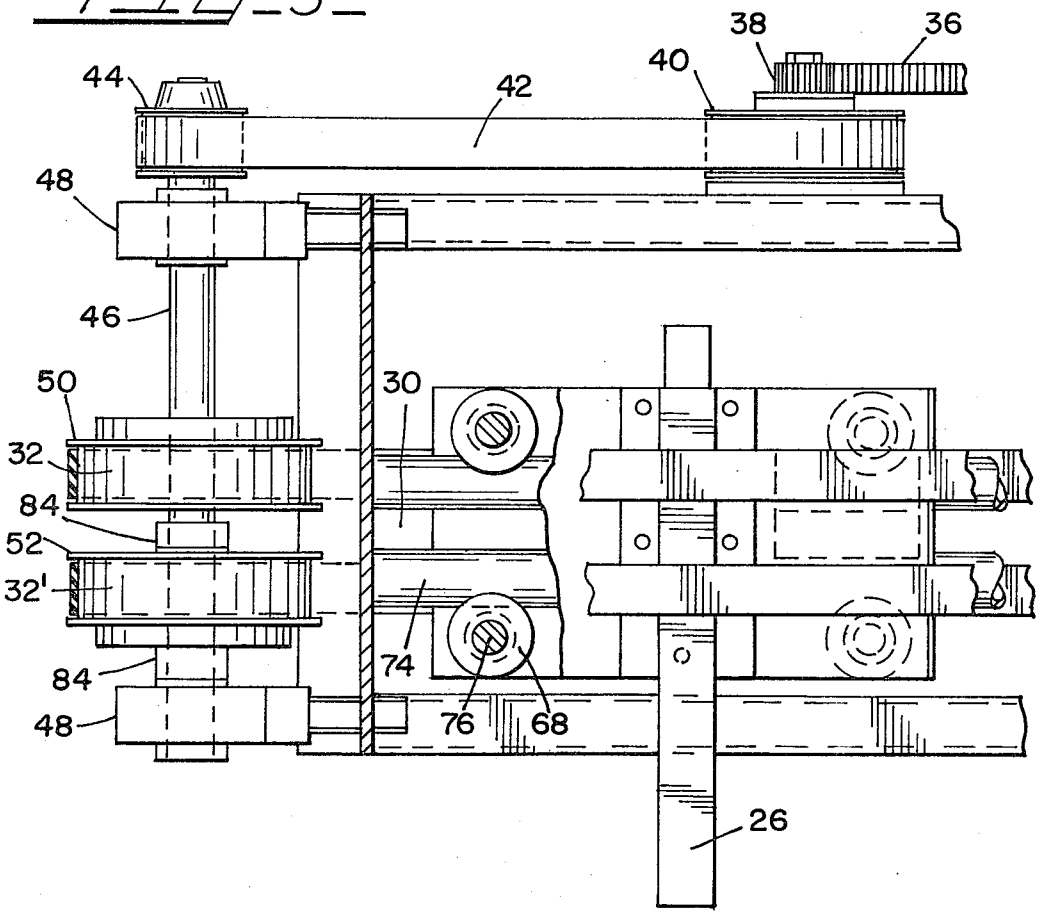
FIG. 3 is a cross-section of the present invention viewed along the line 3—3 in FIG. 1, and illustrates a cut-away view of a carriage.

In the preferred form of the invention, belt 32 is moved through use of a pneumatic system employing a rack and pinion gear arrangement. FIG. 1 discloses pneumatic cylinder 34 which drives rack 36 over pinion gear 38 which is meshed with rack 36, thus causing pinion gear 38 to rotate. Pinion gear 38 is mounted on pulley 40 to transmit torque from pinion gear 38 to pulley 40. Rotation of pulley 40 causes belt 42 to move, such belt 42 being suspended between pulley 40 and drive shaft pulley 44. Drive shaft pulley 44 is secured to the top of drive shaft 46 and drive shaft 46 is held by and rotated within bearings 48. Movement of belt 42 causes drive shaft pulley 44 to rotate with the resultant rotation of drive shaft 46. A carriage drive pulley 50, with belt 32 wrapped about it, is fixed to drive shaft 46 so that rotation of drive shaft 46 causes belt 32 to move. This movement of belt 32 causes lead carriage 22 to move down track 30 to effect a centering and spreading operation. Since the present invention utilizes two carriage pairs, FIGS. 1 and 3 show a second pulley 52 on drive shaft 46 to serve as an idler pulley for a second belt 32'. Such belt 32' act to move a second pair down track 30 which are initially positioned in FIG. 1 at the far right end of centering and spreading apparatus 10, partially hidden by housing 20.

FIG. 1 further discloses abutment blocks 54 which are affixed to the same run of belt 32 as trailing carriage 24. Abutment blocks 54 contacts trailing carriage 24 to conclude a spreading and centering operation.

Upon conclusion of the centering and spreading operation, laundry article 28 is released from clipping means 26. Transfer blades 56 move forward to contact laundry article 28 so that the article is draped onto inlet end 14. The forward movement of transfer blades 56 is achieved by second pneumatic system which includes a pneumatic cylinder 58 which interacts with sliding member 60 to cause movement in pivoting shafts 62 transmitted to transfer blades 56 by arms 64 which are affixed to transfer blades 56 by pivot pins 66.

Figure 2:
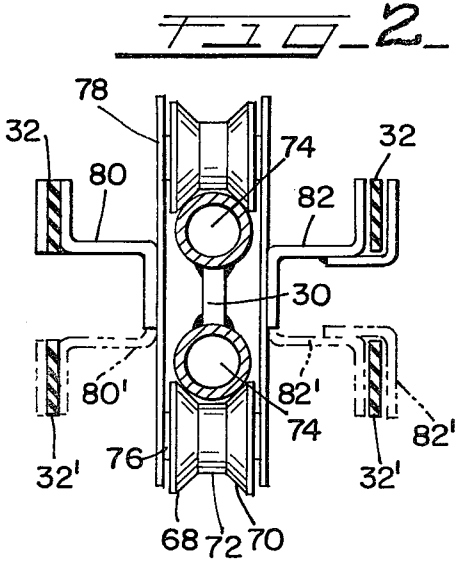
FIG. 2 is a cross-sectional composite view of the carriage, track and belt arrangement for either lead or trailing carriages.

The arrangement and interaction of a lead or trailing carriage with track 30 and belt 32 is illustrated in FIG. 2. The movement of the carriage shown in FIG. 2 is confined to track 30 by roller means 68 having beveled interior side walls 70 to form channels 72. The tubular portions 74 of track 30 fit into channels 72 to permit the carriages to move rapidly on track 30 without becoming derailed. Roller means 68 rotate freely about axils 76 which are secured into carriage housing 78.

FIG. 2 further illustrates lead carriage anchor bracket 80 which is directly affixed to belt 32 and to housing 78. Trailing carriage 24 idles with respect to belt 32 by means of idler bracket 82 which, as illustrated in FIG. 2, allows belt 32 to freely pass through it. Since the preferred form of the invention utilizes two carriage pairs, FIG. 2 also illustrates in dashed lines the positioning of a lead carriage anchor bracket 80' for the lead carriage of a second carriage pair. Also indicated in dashed lines is the positioning of idler bracket 82' to be used on the trailing carriage of a second carriage pair. It is to be understood that FIG. 2 is merely a composite, cross-sectional view of both a lead carriage and trailing carriage.

FIG. 3 illustrates a detailed view of drive shaft 46 which is held by and rotates within bearings 48. Affixed to drive shaft 46 is carriage drive pulley 50 which transmits movement to belt 32 and lead carriage 22 affixed to belt 32. Directly below drive pulley 50 on drive shaft 46 and idling with respect to drive shaft 46 is idler pulley 52. The position of idler pulley 52 is maintained on drive shaft 46 by idler collars 84. A second belt 32' glides freely about idler pulley 54. A drive pulley to move second belt 32' is located at the same relative position as idler pulley 52 on a second drive shaft located at the opposite end of track 30. FIG. 3 further discloses a cut-away view of a carriage showing roller means 68 in contact with tubular portions 74 of track 30.

Figure 4:
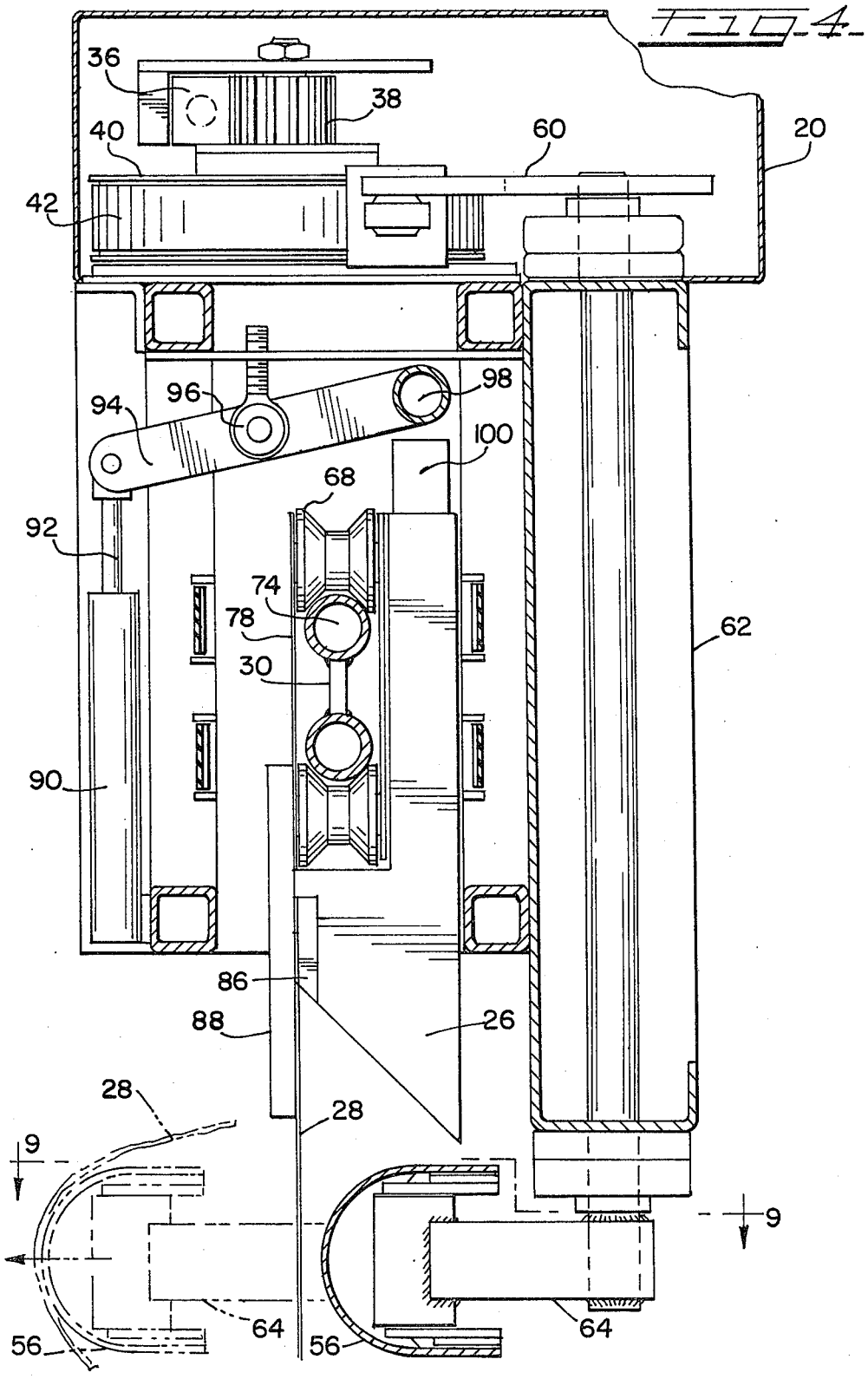
FIG. 4 is a cross-section of the present invention viewed along the line 4—4 in FIG. 1.

FIG. 4 is a cross-sectional view along line 4—4 of FIG. 1. Clipping means 26 is generally shown and is comprised of a gripping plate 86 which wedges laundry article 28 against back plate 88 to secure laundry article 28 within clipping means 26. At the end of one centering and spreading operation the release of clipping means 26 is achieved by pneumatic cylinder 90 having cylinder rod 92 to act upwardly on lever 94 which causes lever 94 to pivot about fulcrum 96 so that contact end 98 contacts and acts downwardly on release plunger 100 causing gripping plate 86 to recede from laundry article 28. After the recession of gripping plate 86, transfer blades 56 move forward to contact laundry article 28, thus transferring the article onto the conveyor. FIG. 4 illustrates the forward movement of transfer blades 56.

Figure 5:
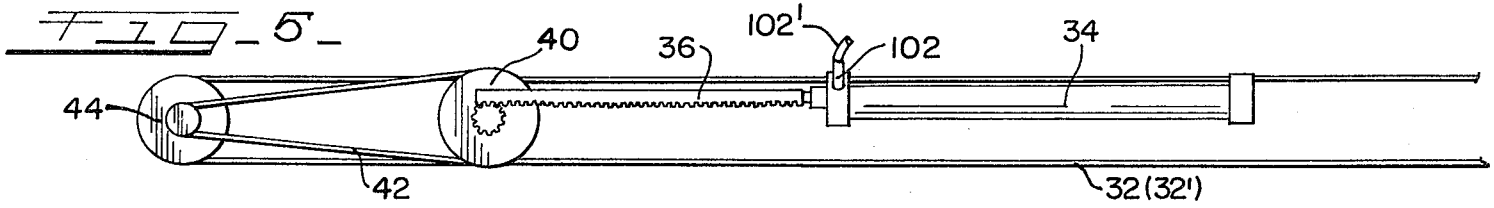
FIG. 5 is a schematic diagram illustrating the pneumatic cylinder rack and pinion gear drive mechanism for the belts.

FIG. 5 is a schematic diagram of a pneumatic cylinder rack and pinion gear drive mechanism which eventually moves carriage belt 32. A second, independent pneumatic system is required to drive second carriage belt 32'. A switch 102 in exhaust line 102' is sensitive to pneumatic pressure within the attached exhaust line, so that when the piston within pneumatic cylinder 34 is prevented from further movement upon completion of one centering and spreading operation, a switch 102 signals a drop in pressure in exhaust line 102' which effects the release of the laundry article from clipping means 26.

Figure 6:
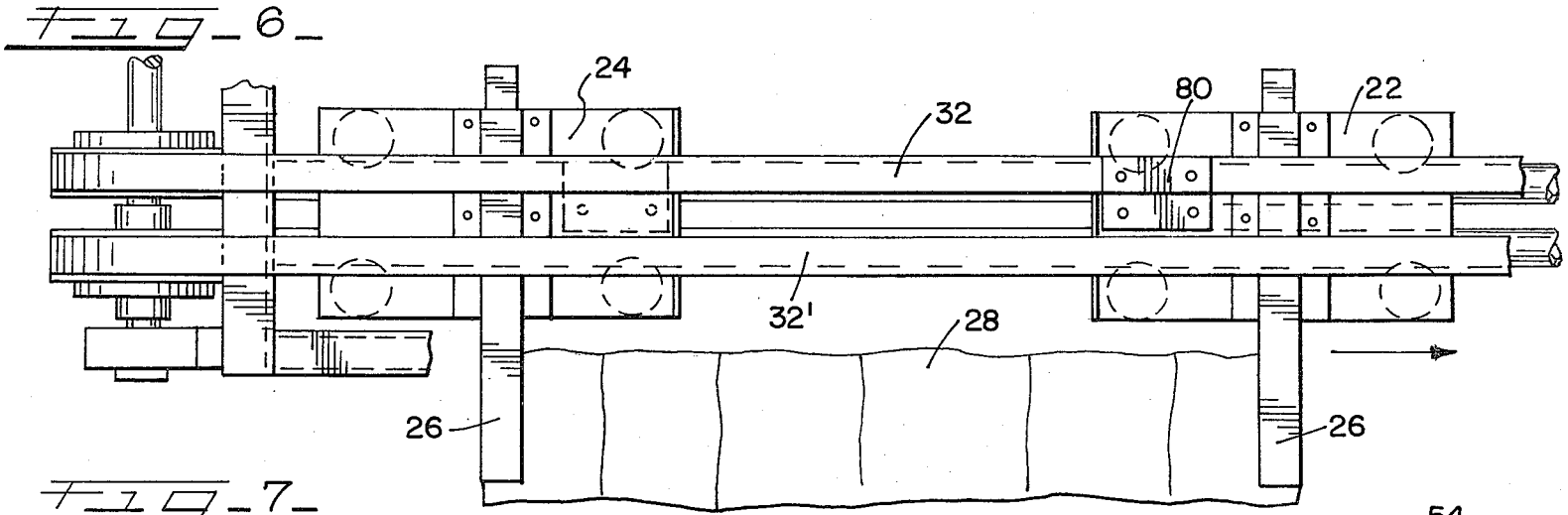
FIG. 6 is a horizontal elevation of a carriage pair shown with a laundry article affixed in its clipping means, at an earlier stage of a spreading and centering operation.

FIG. 6 illustrates an early stage in one spreading and centering operation in which lead carriage 22 and trailing carriage 24 have laundry article 28 affixed to respective clipping means 26. Lead carriage 22 is proceeding down track 30 in the direction indicated by arrow. Trailing carriage 24 begins to move down track 30 as a result of the pull by lead carriage 24 on laundry article 28 after such laundry article has become fully unfurled.

Figure 7:
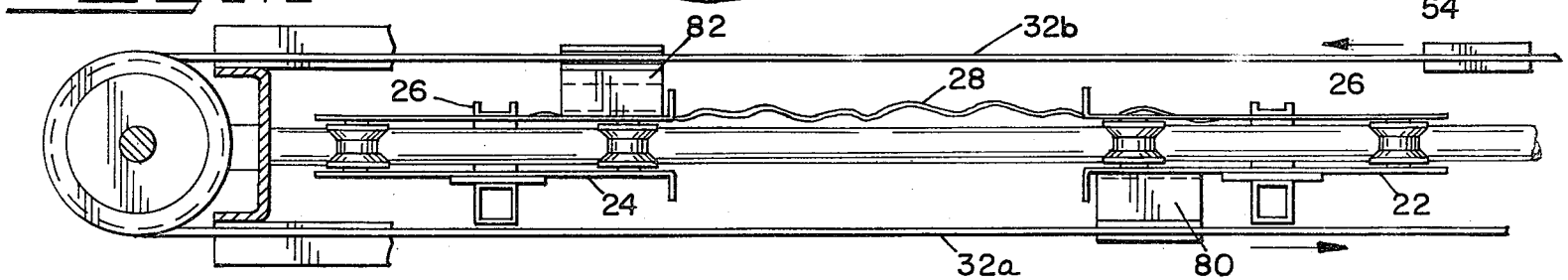
FIG. 7 is a detailed vertical elevation of the carriage pair of FIG. 6.

FIG. 7 provides a top view of FIG. 6 to disclose a first run 32*a* and a second run 32*b* of belt 32. Lead carriage anchor bracket 80 is directly affixed to first run 32*a*. Trailing carriage idler bracket 82 idles with respect to the second run 32*b*. FIG. 7 further discloses abutment block 54 which moves in a direction indicated by arrow. Abutment block 54 is also affixed to second run 32*b* so that when the abutment block contacts the trailing carriage idler bracket 82 the spreading and centering mechanism comes to a complete halt since both further carriage travel and further piston movement within cylinder 34 is prevented.

Figure 8:
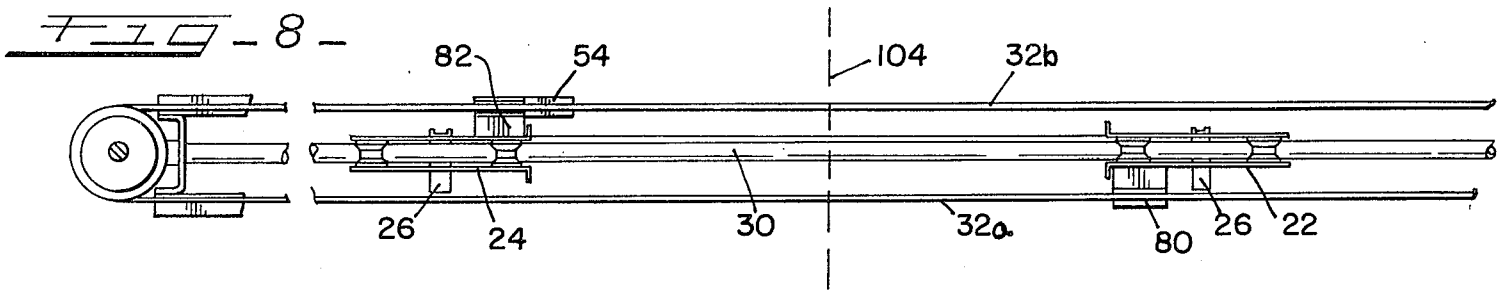
FIG. 8 is a vertical elevation of a carriage pair at the completion of one centering and spreading operation.

FIG. 8 illustrates a carriage pair which has completed one centering and spreading operation so that laundry article 28 is completely tensed and spread about a reference point 104. In FIG. 8 abutment block 54 has contacted trailing carriage idler bracket 82 to arrest any further movement of the carriage pair down track 30.

A novel aspect of the present invention, disclosed in FIG. 8, is that the present invention can accommodate laundry articles of varying widths since abutment block 54 will always contact trailing carriage 24 at such point in time when trailing carriage 24 and lead carriage 22 are equidistantly positioned from reference center-line 104. When abutment block 54 contacts the trailing carriage idler bracket 82, the leading edge of the laundry article 28 is at such point that it is centered exactly about a desired reference line 104.

Figure 9:
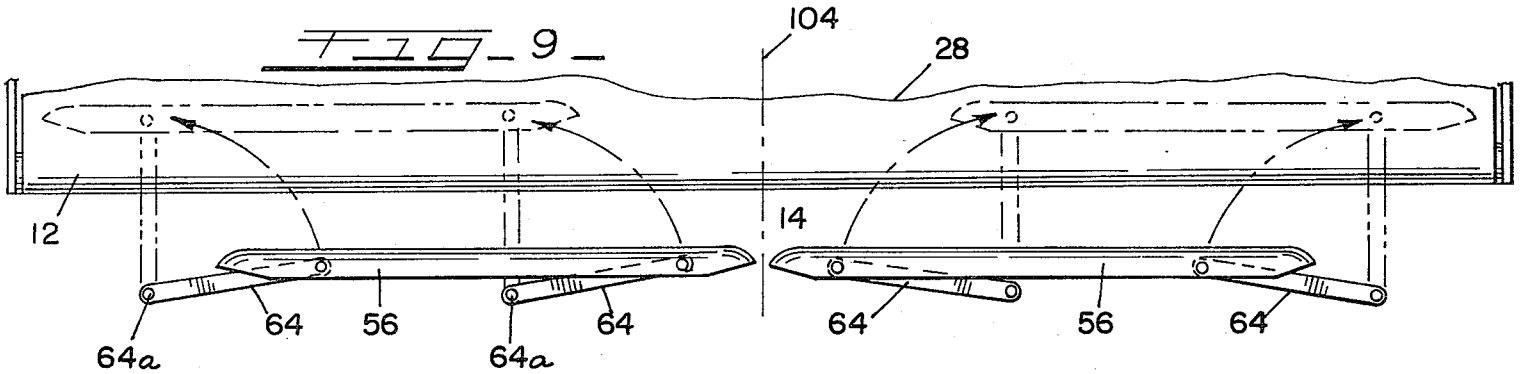
FIG. 9 is a vertical elevation of a transfer operation of a laundry artical onto the inlet end of the conveyor, viewed along line 9—9 in FIG. 2, illustrating the movement of the mechanical transfer blades.

The synchronous forward movement of transfer blades 56 is illustrated in FIG. 9 as viewed along line 9—9 of FIG. 4. This movement of transfer blades 56 urges the article upon the inlet end 14 of the automatic feeding conveyor yet maintaining the centering of the article about reference center-line 104. Transfer blades 56—56 are supported in a manner where they are in end-to-end relation and parallel to the rear vertical side of the upper end portion of the draped and spread apart laundry article positioned adjacent to the inlet end of the conveyor. The blades 56—56 are each pivotally supported at the opposite ends thereof upon a pair of arms 56—56 pivoted about vertical pivot axes 64*a*—64*a*. The pairs of arms 56—56 and 56—56 have a mirror-image relationship with respect to the center-line 104. After a laundry article has been spread and draped in front of the inlet conveyor, the pairs of arms 64—64 are pivoted forwardly about the axes 64*a*—64*a* and 64*a*—64*a* so as to maintain the parallel relation of the blades to the vertical side of the laundry article. When the blades reach the article, the article is released from the clipping means so that the blades push the upper end of the draped laundry article upon the conveyor. The pairs of arms 64—64 and 64—64 and blades 64—64 on the opposite side of the center-line 104 are moved bodily in a direction away from this center-line.

Figure 10:
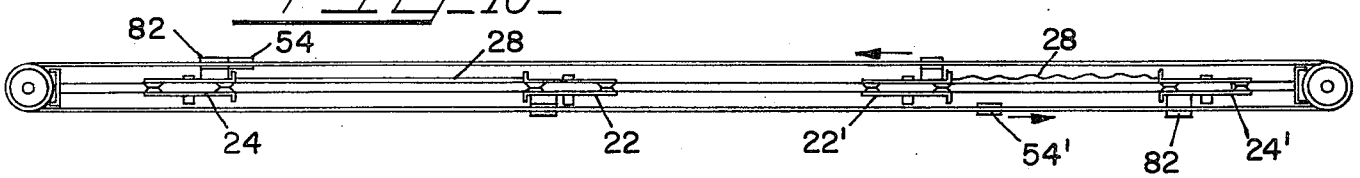
FIG. 10 is a vertical elevation of the present invention illustrating the two-lane mode of operation.

Finally, FIG. 10 illustrates a mode of the invention in which the position of abutment blocks 54 has been manually adjusted so that inlet end of the automatic feeding conveyor has been divided into a two-lane feeding system. In order to operate the apparatus of the present invention as a two-lane system, it is necessary that the apparatus be provided with an interlock and hold mechanism (not illustrated) to prevent the collision of opposing lead carriages which could result if laundry operators, from their respective loading station, attempted to simultaneously center and spread laundry articles on the present invention. It should be noted that because a vertical elevation is used in FIG. 10, a second carriage belt is not shown which, of course, would be necessary to drive the lead carriage of the second carriage pair. In FIG. 10, the lead carriage 22 and trailing carriage 24, located on the left side of the apparatus illustrated, has completed a spreading and centering operation. The carriage pair on the right side of the disclosed apparatus comprised of lead carriage 22' and trailing carriage 24' is in the process of completing a centering and spreading operation in which abutment block 54 has yet to contact trailing carriage idler bracket 82.

While the invention has been described with reference to a particular preferred embodiment, it will be understood by those skilled in the art that various changes may be made and equivalence may be substituted for elements thereof without departing from the scope of the invention. Specifically, many modifications may be made to adopt a particular situation or material to the teachings of the invention without departing from the essential scope of the inventive concept. Thus, it is intended that the invention not be limited to the particular embodiment disclosed as the best mode contemplated for carrying out this invention, but rather that the invention will include all embodiments falling within the scope of the claims which follow hereafter.

I claim:

1. An apparatus for centering and spreading laundry articles comprising: clipping means for gripping respective parts of a leading edge of a laundry article; respective carriages for conveying said clipping means; a track means along which said carriages can move from a contiguous initial position at a first loading station to a spaced apart position when the article has become fully spread out; an endless elongated means having a first run and a second run which extend along said track means; a lead carriage being fixed to said first run; a trailing carriage which idles with respect to said second run; an abutment means fixed to said second run and initially positioned equidistantly on the opposite side of a reference center-line from which said lead carriage is initially positioned therefrom while said carriages are at said leading station; and a drive means for moving said endless elongated means in one direction to draw said lead carriage along said track from said loading station and then in the reverse direction to return said lead carriage to said loading station, such that upon activation of said drive means, said endless elongated means moves in said one direction moving said lead carriage, with a respective laundry article edge gripped in said clipping means, along said track spreading out the laundry article, said lead carriage and said abutment means are moving toward each other crossing at said reference center-line then moving apart so that when said lead carriage draws one-half of the width of said article beyond said reference center-line, said abutment means will contact said trailing carriage having a respective edge of said article gripped in said clipping means, thus arresting further movement of said trailing and lead carriages and leaving said article spread and centered with respect to said reference line.

2. The apparatus for centering and spreading laundry articles of claim 1, wherein there is provided a second loading station positioned at the opposite end of said apparatus from said first loading station; a second endless elongated means having a first and a second run; a second drive means to move said second endless elongated means in reversable directions; clipping means for gripping respective edges of a laundry article; a second carriage pair for conveying said clipping means initially positioned at said second loading station and having a second lead carriage fixed to said first run of said second endless elongated means, and a second trailing carriage fixed to said second run of said second endless elongated means; and a second abutment means fixed to said second run of said second endless elongated means and equidistantly positioned at the opposite side of a reference center-line from which said second lead carriage is positioned therefrom, such that the above additional elements operate along said track means in the same manner as said elements described in claim 1.

3. The apparatus for centering and spreading laundry articles of claim 2, wherein the position of each said abutment means with respect to each said second run of each endless elongated means is independently adjustable so that the position of said reference center-line about which both carriage pair center, may be varied to provide a center-line for each carriage pair, thus dividing an inlet end of a conveyor into a two-lane system.

4. The apparatus for centering and spreading laundry articles of claims 1 or 2, wherein said abutment means includes a rigid rectangular block capable of being moved with respect to said second run of said endless elongated means.

5. The apparatus for centering and spreading laundry articles of claims 1 or 2 further comprising: means for sensing when said abutment means contacts said trailing carriage to initiate the release of the article from said clipping means, and means for transferring the article from said clipping means to a conveyor belt upon release of the article from said clipping means.

* * * * *